US005407412A

United States Patent [19]

Plevnik et al.

[11] Patent Number: 5,407,412

[45] Date of Patent: Apr. 18, 1995

[54] METHOD, SET OF PARTS AND DEVICE FOR TESTING AND/OR STRENGTHENING PELVIC FLOOR MUSCLES

[76] Inventors: Stanislay Plevnik, Na Grivi 20, Dragomer, Brezovica Pri; Marko Stular, Brateov Ucakar 99 61000, both of Ljubljana, Yugoslavia

[21] Appl. No.: 810,441

[22] Filed: Dec. 19, 1991

Related U.S. Application Data

[63] Continuation of Ser. No. 433,166, Nov. 8, 1989, abandoned, which is a continuation-in-part of Ser. No. 239,027, Aug. 30, 1988, Pat. No. 4,895,363, which is a continuation of Ser. No. 849,393, Apr. 8, 1986, abandoned.

[30] Foreign Application Priority Data

Nov. 18, 1988 [GB] United Kingdom ..... 8827048

[51] Int. Cl.[6] ..... A63B 21/065

[52] U.S. Cl. ..... 482/105; 482/148

[58] Field of Search ..... 482/148, 92, 93, 105

[56] References Cited

U.S. PATENT DOCUMENTS

| | | | |
|---|---|---|---|
| 2,763,265 | 9/1956 | Waters | 128/67 |
| 3,838,853 | 10/1974 | Fredenhagen | 272/119 |
| 3,924,851 | 12/1975 | Winston | 272/119 |
| 4,241,912 | 12/1980 | Mercer et al. | 272/125 |
| 4,253,660 | 3/1981 | Tiktin | 272/119 |
| 4,369,967 | 1/1983 | Kimura | 272/119 |
| 4,384,714 | 5/1983 | Kimura | 272/119 |
| 4,895,363 | 1/1990 | Plevnik et al. | 600/29 |

FOREIGN PATENT DOCUMENTS

| | | | |
|---|---|---|---|
| 2058571 | 4/1981 | United Kingdom | 272/93 |

OTHER PUBLICATIONS

Peattie A. B., Plevnik S., Stanton, Vaginal Cones: a conservative method of treating genuine stress incontinence, British Journal of Obstetrics and Gynaecology, 95: 1049–1053.

Peattie A. B., Plevnik S. Cones versus physiotherapy as conservative management of genuine stress incontinence, Proceedings of the 18th Annual Meeting of the International Continence Society, Oslo, pp. 265–266, 1988.

Bridges N., Denning J., Olah K. S., Farrar D. J., A prospective trial comparing interferential therapy and treatment using cones in patients with symptoms of stress incontinence, Proceedings of the 18th Annual Meeting of the International Continence Society, Oslo, pp. 267–268, 1988.

Zanollo A., Vaginal cones: a new method to treat stress urinary incontinence, Proceedings of the 2nd National Congress of the Italian Urodynamic Scoiety, Rome, pp. 39–43, 1988.

Marks Handbook for Mechanical Engineers, 8th Edition 1978, pp. 6–162.

*Primary Examiner*—Stephen R. Crow
*Attorney, Agent, or Firm*—Lalos & Keegan

[57] ABSTRACT

A plurality of devices having a physiologically inert plastics outer surface and each have identical size and shape, but are of graded weights. A device is inserted into the vagina of a subject, and if the pelvic floor muscles are capable of retaining that weight, the device is replaced by a heavier one. The heaviest device that can be retained is a measure of a pelvic floor muscle strength, and the muscles can be exercised by retaining the device for a predetermined time, such as 15 to 20 minutes per day.

23 Claims, 1 Drawing Sheet

Figure 1:
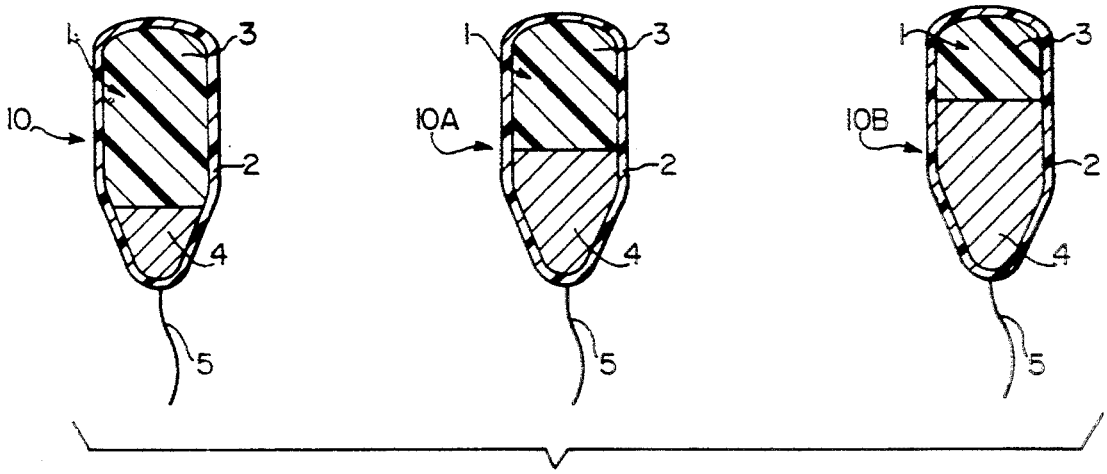

METHOD, SET OF PARTS AND DEVICE FOR TESTING AND/OR STRENGTHENING PELVIC FLOOR MUSCLES

This application is a continuation of U.S. application Ser. No. 07/433,166, filed on Nov. 8, 1989, now abandoned which is a continuation-in-part of U.S. application Ser. No. 07/239,027, filed Aug. 30, 1988, now Pat. No. 4,895,363, which is a continuation of U.S. application Ser. No. 06/849,393, filed Apr. 8, 1986, now abandoned.

The present invention relates to a device and a set of parts for testing and/or strengthening pelvic floor muscles. The invention also relates to a method of testing and/or strengthening pelvic floor muscles using the device.

Exercises for pelvic floor muscles (PFM) as usually prescribed by physicians have certain limitations; women can have difficulty in experiencing the pelvic floor muscle action and they have no information as to how strong the muscles actually are.

To overcome this deficiency, different "perineometer" devices based on biofeedback principles have been developed, and used with the aim of ensuring more efficient and reliable exercising by giving the woman information on proper contraction of the PFM. A typical device of this type consists of a vaginal probe connected to an external unit which provides either audio or visual feedback of any changes in vaginal pressure.

GB 2058571 describes a device for exercising the perineal muscles which comprises a shaft having a tapered portion with an enlarged spherical end for insertion in the vagina and provision for suspending various weights from the other end of the shaft.

U.S. Pat. No. 4,241,912 describes an isometric vaginal exercise device comprising a rounded shaft having a flange at one end thereof. The shaft has a concave portion adjacent the flange, wherein the diameter of the concave portion decreases to a minimum value and then increases to maximum value with increasing distance from the flange. The concave portion allows gripping of the device by perivaginal muscles of the user. The flange is oval to permit accommodation between the legs of the user. A handle is attached to the flange end of the device.

The main disadvantages of the above techniques are:

(i) Exercising of the PFM may not be reliable, especially when using a perineometer. At rest and during exercises, the vagina is exposed not only to contractions of the pelvic floor but also to any changes in abdominal pressure. This allows for the possibility that, during exercising with a perineometer, the subject will have a similar chance of exercising either only PFM or only abdominal muscles or both, the reading on the perineometer not distinguishing between these alternatives.

(ii) The devices are somewhat complicated in design as well as inconvenient for the subject's use.

In one embodiment, the present invention includes a set of parts for testing and/or strengthening pelvic floor muscles, comprising a plurality of devices each having a substantially identical size and shape such that each device can be inserted into the vagina of a subject, the devices being of different weights such that for a given subject the pelvic floor muscles will be capable of supporting a said device up to a particular weight. Each of the devices generally approximates to a solid of revolution and may preferable include a right cylindrical portion and a generally conical portion ending in a rounded tip. In order to prepare a set of devices with substantially identical size and shape, each device may conveniently be formed from two or more materials having different densities. By varying the proportion of each material in the devices, a set can be produced having different weights but the same size and shape. A combination of a plastics material such as polymethylmethacrylate or nylon with a metal such as brass or stainless steel may be used to form the devices. In one embodiment, the devices are formed with a polymethylmethacrylate portion bonded to a brass portion, the size of each portion being selected to give the desired weight to the device. Using these materials we have found it possible to produce devices having an advantageous combination of weight, size and shape. The brass portion is generally provided with a physiologically acceptable coating e.g. by chromium plating. However, it has been found that in some circumstances it is not desirable for the subject, especially the delicate tissue of the subject within the vagina, to come into contact with the metal part of the devices.

In one aspect, the invention provides a device for testing and/or strengthening pelvic floor muscles, the device having longitudinal axis about which it at least approximates a solid of revolution, the size and weight of the device being such that it can be retained within the vagina of a patient using the pelvic floor muscles, and the device having a physiologically inert plastics outer surface.

In a further aspect the invention provides a set of parts for testing and/or strengthening pelvic floor muscles, comprising a plurality of devices each having a substantially identical size and shape such that each device can be inserted into the vagina of a subject, the devices being of different weights such that for a given subject the pelvic floor muscles will be capable of supporting a said device up to a particular weight, and each of the devices having a physiologically inert plastics outer surface.

The devices according to the invention are generally of size and shape such that they may be fully inserted into the vagina of a subject. In a set of parts according to the invention, the devices are of substantially identical size and shape. However, it will be appreciated that minor variations in size and shape may occur between different devices in a set provided that each device may be inserted, preferably fully inserted, into the vagina of a subject.

The outer surface of devices according to the invention which in use will come into contact with the subject comprises a physiologically inert plastics material. The term "physiologically inert" is intended to mean that the plastics material is generally not capable of adversely reacting with the vaginal tissue of a healthy subject to produce any abnormal physiological state. Examples of plastics materials which may be used on the outer surface of the device according to the invention include nylon, polymethylmethacrylate, polyethylene, polypropylene, polytetrafluoroethylene (Teflon), and preferably acrylonitrile-butadiene-styrene (ABS) polymers.

Each of the devices generally approximates to a solid of revolution and may preferable include a right cylindrical portion and a generally conical portion ending in a rounded tip. In order to prepare a set of devices with substantially identical size and shape, each device may conveniently be formed from two or more materials having different densities provided that the device has an outer surface of physiologically inert plastics. By varying the proportion of each material in the devices, a set can be produced having different weights but the same size and shape. Conveniently, a combination of a plastics material such as ABS with a metal core portion may be used to form the devices. Since the outer surface of each device comprises the physiologically inert plastics material, the nature of metal used for the core is not important. Examples of metals which may be used for the core include lead, zinc, aluminum, brass, iron, steel, copper and mixtures thereof. It will be appreciated that combinations of other materials could be used in making the devices, e.g. combinations of two or more plastics materials. When a combination of materials, such as of metal and plastics, is used to form a device, the plastics may be provided over a metal and plastics core. In one embodiment, the devices may be formed with a polymethylmethacrylate portion bonded to a brass portion with a surface layer of physiologically inert plastics, the size of each portion being selected to give the desired weight to the device. Preferably, the devices comprise a lead core embedded within ABS, the size of the lead core being varied between devices to provide different weights while the shape and size of each device in a set is kept substantially constant. Using these materials we have found it possible to produce devices having an advantageous combination of weight, size and shape.

From a second aspect, the present invention provides a method of testing pelvic floor muscles utilizing a plurality of devices according to the invention, the method comprising:

inserting one of the devices and checking whether the pelvic floor muscles can support the device;

if so, replacing the device with a heavier device, and if not, replacing the device with a lighter device; and repeating the above steps until one of the devices is just capable of being supported, the weight of that device providing an indication of the pelvic floor muscle strength.

The present invention also provides a method of exercising pelvic floor muscles based on the above determination of the weight which is just supported when voluntary holding is exerted, the device having that weight being retained by the subject for a predetermined time.

Preferred aspects of the invention provide a biofeedback technique for testing and reliable exercising of the pelvic floor muscles.

Figure 2:
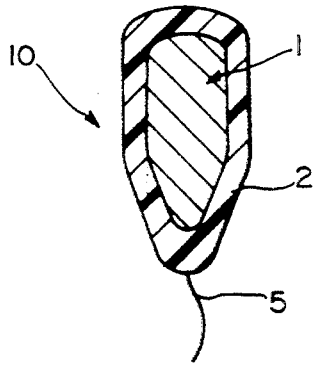
Figure 3:
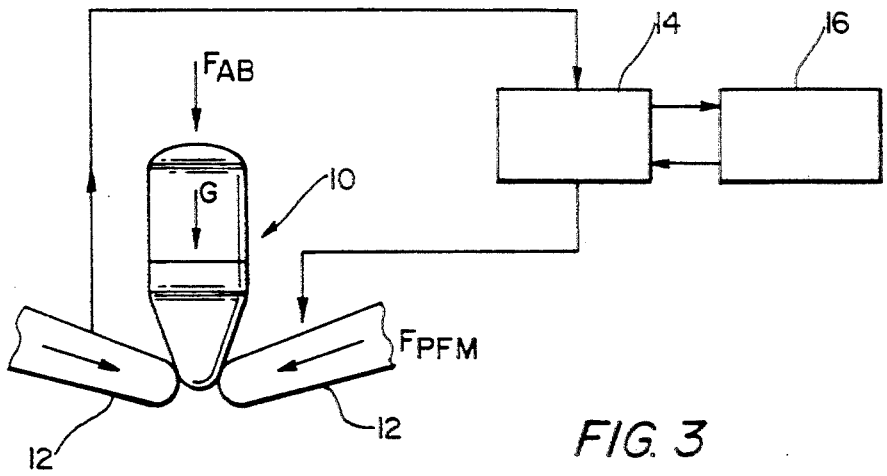

The invention will now be described, by way of example, with reference to the accompanying drawings in which:

FIG. 1 schematically shows a set of devices according the invention, each device of the set being a variation of one embodiment of a device according to the invention in cross-section;

FIG. 2 schematically illustrates a second embodiment of a device of the invention in cross-section; and FIG. 3 schematically illustrates a preferred technique of the invention.

Referring to FIGS. 1 and 2, the devices or "cones" 10 comprise a core 1 and an outer surface material 2 of physiologically inert plastics. In the embodiment of FIG. 1 the core 1 is made up from two materials 3 and 4 of different densities, e.g. of metal and plastics (which may be the same as or different from the plastics of surface material 2). By varying the relative proportions of materials 3 and 4 (as illustrated for example by device 10A and 10B), devices of different weights but substantially identical size and shape may be manufactured.

In the embodiment shown in FIG. 2, the core 1 comprises a single material of density different from that of surface material 2, e.g. of metal. In this case, devices of different weight may be manufactured by varying the size of the core 1 within different thicknesses of surface material 2 so that the devices have substantially identical size and shape.

A thread 5 may conveniently be provided to aid removal of the devices from the vagina. A set of cones for use according to the invention comprises two or more devices 10, but in practice a set will conveniently contain up to nine or more such cones, preferably about 5 cones. In the set the cones 10 are of substantially identical size and shape for insertion into the vagina of a subject but each is of different weight. As indicated above, minor variations in shape and size may occur between cones in a set; for example the radius of curvature of the conical tips of the cones or the length of the conical portion may vary between cones.

One preferred method of the invention employs a set of nine devices or "cones"(each as shown, for example, in FIGS. 1 and 2) of equal shape and volume but different weights gradually increasing from cone to cone e.g. in the range from 10 to 100 gm with appropriate weight increments between cones in the set. In alternative embodiments 5, 6 or 7 cones may be used, e.g. having weights incrementally increasing from 20 to 70 gm. When the cone of the appropriate weight is inserted into the vagina it tends to slip out. This feeling of "losing the cone" provides a powerful sensory biofeedback which makes the pelvic floor muscles contract around the cone, thus retaining it. This path is shown schematically in FIG. 3 as including the pelvic floor muscles 12, the sacral cord 14 and the central nervous system 16. As illustrated in FIG. 3, the device is generally inserted into the vagina with the tapered end of the device directed outwardly.

In the method of the present invention, the cones are successively inserted into the vagina in the standing position. The heaviest cone that can be retained in the vagina while standing and during walking without voluntary holding is taken to be a measure of the resting PFM strength. The heaviest cone that could be retained in the vagina during standing and walking for 1 minute during voluntary holding may be taken to be the measure of the active pelvic floor muscle strength.

The cone which can still be comfortably retained by voluntary holding (this is usually the cone which is one step heavier than the cone representing the resting PFM strength) may be given to the subject for exercising. The subject should be instructed that the cone will try to slip out of the vagina and that she should try to prevent that by contracting the muscles. 15 to 20 minutes exercise once or twice a day, may be performed during walking or standing at home for a period of one month. After this time a considerable increase of PFM strength is usually achieved.

The method ensures reliable exercising of PFM. The sensory biofeedback provided by the feeling of "losing the cone" makes the pelvic floor muscles contract during retaining the cone. The possible increase of abdominal pressure will demand even stronger pelvic floor contraction in order to retain the cone. It is expected that these exercises will prove useful in the treatment of incontinence.

The cone 10 is shown as including a right cylindrical portion and a generally conical portion ending in a rounded tip. Other shapes may be suitable but should generally have symmetry about a longitudinal axis so as to approximate a solid of revolution. It may be possible to utilize a facetal construction rather than a curved one, but in that case, a relatively large number of facets should be provided to approximate to the preferably rounded shape.

We claim:

1. A set of parts for testing and/or strengthening pelvic floor muscles, comprising a plurality of devices each having a substantially identical size and shape such that each device can be fully inserted into the vagina of a human subject, the devices being of different weights such that for a given subject, the pelvic floor muscles will be capable of supporting a said device up to a particular weight, and each of the devices having a physiologically inert plastics outer surface.

2. A set of parts according to claim 1, wherein each device has a longitudinal axis about which it at least approximates a solid of revolution.

3. A set of parts according to claim 1, wherein each device comprises a generally conical portion.

4. A set of parts according to claim 3, wherein the generally conical portion of each device is rounded at the tapering end, and wherein the device also has a generally right cylindrical portion at the outer end of the generally conical portion.

5. A set of parts according to claim 1, wherein the weights of the devices include the range 10 to 100 gm.

6. A set of parts according to claim 1, wherein the weights of the devices vary in steps of from 5 to 20 gm.

7. A set of parts according to claim 1 wherein up to nine devices are provided.

8. A set of parts according to claim 1 wherein the physiologically inert plastics is ABS.

9. A set of parts according to claim 1 wherein each device is formed from at least two materials having different densities and the weight of each device is differentiated from the weight of another by a different proportion of said materials.

10. A set of parts according to claim 9 wherein each device comprises a metal core embedded in the physiologically inert plastics.

11. A set of parts for testing and strengthening pelvic floor muscles, comprising a plurality of exercise devices each having a substantially identical size and shape and having a fixed volume such that each of said devices can be fully inserted into the vagina of a human subject, each of said exercise devices in said set having a weight different from each of the other exercise devices in said set such that for a given human subject, the pelvic floor muscles will be capable of supporting one of said devices having a particular weight, and whereby progressively heavier devices in said set can be inserted successively into the vagina of a human subject until the heaviest retainable weight in said set is determined, said heaviest retainable weight providing an indication of pelvic floor muscle strength and proper weight for exercise.

12. A set of parts according to claim 11 wherein each device has a longitudinal axis about which said device approximates a solid of revolution.

13. A set of parts according to claim 11 wherein each device comprises a generally conical portion.

14. A set of parts according to claim 13, wherein the generally conical portion of each device is rounded at the tapering end, and wherein the device also has a generally right cylindrical portion at the other end of the generally conical portion.

15. A set of parts according to claim 11, wherein the weights of the devices include the range 20 to 100 gm.

16. A set of parts according to claim 15, wherein the weights of the devices vary in 10 gm steps.

17. A set of parts according to claim 11 wherein nine devices are provided.

18. A set of parts according to claim 11 wherein each device is formed from at least two materials having different densities and the weight of each device is differentiated from the weight of another device by a different proportion of said materials.

19. A set of parts according to claim 13 wherein the weights of the devices include the range 20 to 100 gm.

20. A set of parts according to claim 13 wherein nine devices are provided.

21. A set of parts according to claim 13 wherein each device is formed from at least two materials having different densities and the weight of each device is differentiated from the weight of another by a different proportion of said materials.

22. A set of parts for testing and strengthening pelvic floor muscles, comprising a plurality of exercise devices each having a substantially identical size and shape and having a fixed volume such that each of said devices can be fully inserted into the vagina of a human subject, each of said exercise devices having a weight different from the weight of each of the other of said exercise devices, and each of said exercise devices comprising at least two portions, a first one of said portions of each of said exercise devices having a first weight, and a second one of said portions of each of said exercise devices having a second weight, whereby the weight of each of said exercise devices is determined by the combined weights of each of said portions in said fixed volume.

23. A set of parts for testing and strengthening pelvic floor muscles, comprising a plurality of exercise devices each having substantially identical size and shape and having a fixed volume such that each of said devices can be fully inserted into the vagina of a human subject, each of said exercise devices having a weight different from the weight of each of the other devices in said set, each of said devices being formed from at least two materials having different densities, the proportion of each material being varied between devices in said set, whereby progressively heavier devices in said set can be inserted successively into the vagina of a human subject until the heaviest retainable weight in said set is determined, said heaviest retainable weight providing an indication of pelvic floor muscle strength and proper weight for exercise.

* * * * *